US005157900A

United States Patent [19]

Kupersmit

[11] Patent Number: 5,157,900

[45] Date of Patent: Oct. 27, 1992

[54] MEANS AND METHOD FOR SHIPPING HAZARDOUS CONCENTRATES

[76] Inventor: Julius B. Kupersmit, 299 W. 12th St., New York, N.Y. 10014

[21] Appl. No.: 757,190

[22] Filed: Sep. 10, 1991

[51] Int. Cl.[5] ..... B65B 29/06

[52] U.S. Cl. ..... 53/449; 53/468; 53/474; 206/577; 229/117.07

[58] Field of Search ..... 53/449, 474, 50, 431, 53/428, 459, 458, 457, 468, 111 RC, 111 R, 175; 206/577; 229/117.04, 117.05, 117.07, 117.02

[56] References Cited

U.S. PATENT DOCUMENTS

| | | | |
|---|---|---|---|
| 3,782,619 | 1/1974 | Dittbenner | 206/577 X |
| 3,802,919 | 4/1974 | Saffir | 53/431 X |
| 4,101,052 | 7/1978 | Dove | 229/117.02 X |
| 4,174,598 | 11/1979 | Shepherd et al. | 53/474 X |
| 4,205,750 | 6/1980 | Dews | 53/474 X |
| 4,348,421 | 9/1982 | Sakakibara et al. | 53/474 X |
| 4,986,217 | 1/1991 | Robinson et al. | 229/117.02 X |
| 5,090,614 | 2/1992 | Kupersmit | 229/117.04 |

*Primary Examiner*—James F. Coan

*Attorney, Agent, or Firm*—Charles E. Temko

[57] ABSTRACT

An improved means and method for shipping industrial sized quantities of hazardous concentrates which simplifies compliance with current environmental protection regulations. The method includes the steps of loading a collapsible shipping container with a collapsible bag which is partially filled with a liquid or particulate concentrate of a potentially hazardous material, collapsing the bag before inserting it into the shipping container. The container itself is then collapsed, sealed and shipped to the user. Upon arrival, the user erects the container, unfolds and fills the bag with a solvent such as water to fill the container and serve as a storage facility. The diluted or dissolved product is then drawn from the container as required until the container is empty. The user then collapses the bag and the container for return to the sender. As a result, no permanently installed storage facility need be cleaned. The container is configured to form a generally planar storage well at a lower end thereof to store the bag and a reinforcing tray may be provided to enclose the collapsed bag.

9 Claims, 3 Drawing Sheets

MEANS AND METHOD FOR SHIPPING HAZARDOUS CONCENTRATES

BACKGROUND OF THE INVENTION

This invention relates generally to the field of collapsible reusable shipping containers, and more particularly to an improved type of such container and a novel method of using the same for the shipment of hazardous or potentially hazardous materials in concentrated condition to a user.

It is known in the art to provide collapsible containers for the shipment of liquid of particulate materials to a user who uses the container in erected condition as a storage facility while progressively emptying the same. The container is subsequently collapsed for return shipment to the sender for reuse. Such containers are most conveniently made of fibrous materials such as multiply corrugated board and are configured to form a generally rectangularly shaped well at a lower end thereof for the storage of collapsed parts of the container, the well being closed by placing the cover of the container thereon.

Fibrous containers can also be equipped to ship materials in liquid form by providing a collapsible synthetic resinous bag having an inlet at the upper end thereof and an outlet at the lower end thereof. In some cases, a fibrous insert liner element is provided to prevent bulging of the container after loading.

Many such materials shipped in liquid form ar relatively dilute solutions of materials containing water or other readily available diluents or solvents. The cost of shipping the water content is relatively high, and in many cases, the contents which are relatively safe from an ecological standpoint, when in concentrated form, become hazardous only when activated by the solvent.

This problem can be avoided to a degree by the shipping of the concentrate in the absence of the solvent. The problem arises in that large quantities of liquid concentrates are often inherently dangerous, and thus require steel drums for shipment, which are costly to use, and must be thoroughly cleaned to environmental standards before return, a costly process which makes their use all but prohibitive. In the case of particulate concentrates shipped in large quantities, smaller amounts must be individually mixed for use and stored in non-disposable storage facilities. These facilities must also be thoroughly cleaned at frequent intervals to the same standards, again, a relatively expensive inconvenience.

SUMMARY OF THE INVENTION

Briefly stated, the invention contemplates the provision of an improved method and related structure for avoiding the above-mentioned disadvantages. To this end, the method includes the provision of an improved collapsible container, a lower portion of which forms a non-collapsible rectangularly shaped well which accommodates a rimmed tray insert. The tray includes a collapsible impervious bag partially filled with a particulate or liquid concentrate which is relatively non-hazardous in such condition. The container is shipped to the user in collapsed condition with the bag closed and sealed. Upon arrival, the user erects the container to full size and unfolds the bag to permit filling with locally supplied diluent or solvent. After the concentrate has been diluted or dissolved to required strength, the bag serves as a storage container from which the contents are drawn from the lower end of the bag as required. When the bag is emptied, the bag is collapsed, restored in the well of the container, or discarded, following which the container is collapsed and reshipped to the sender for reuse. No cleaning operations are necessary on the part of the user.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 6:
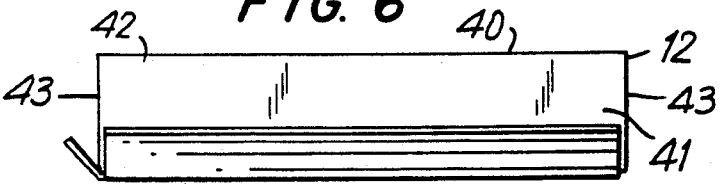
FIG. 6 is a side elevational view of the container in collapsed condition with the cover element in place.
Figure 7:
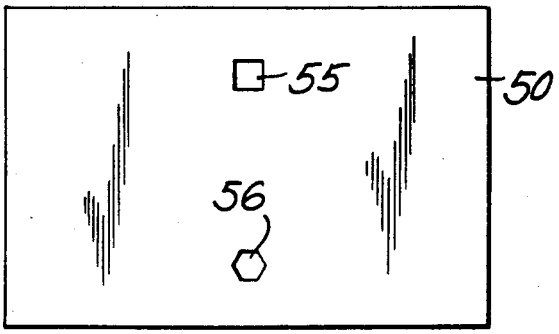
FIG. 7 is a side elevational view of the liner element in erected condition.

In accordance with the invention, the device, generally indicated by reference character 10, comprises broadly: a main body element 11, a cover element 12, (FIG. 6) a liner element 13, a tray element 14, and an expendable flexible synthetic resinous bag element 15. The elements 11 through 14, inclusive, are of multiply corrugated board, and are fabricated using techniques well known in the art.

Figure 1:
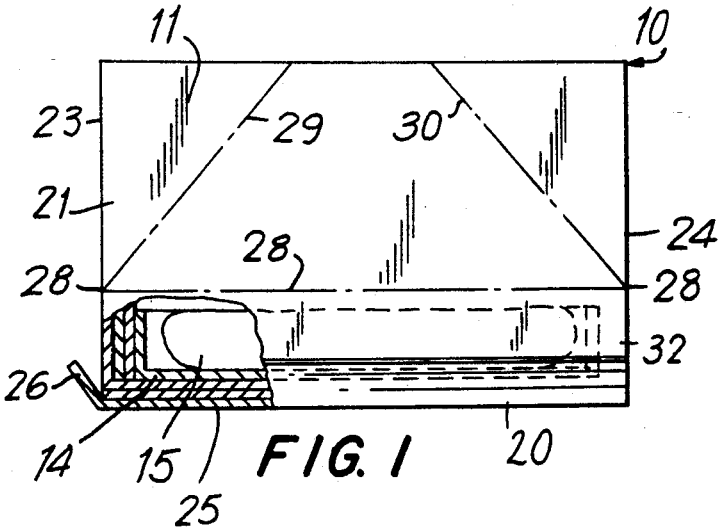
FIG. 1 is a side elevational view of a collapsible shipping container embodying the invention in fully erected condition.
Figure 2:
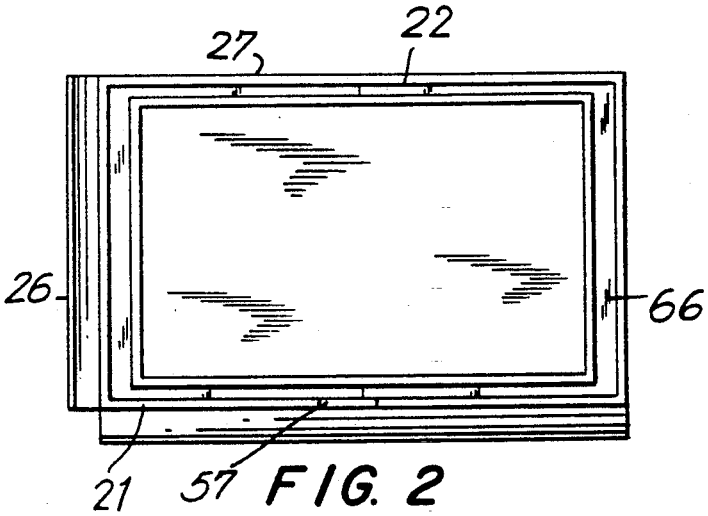
FIG. 2 is a top planar view thereof with a cover element and reinforcing liner element removed for purposes of clarity.
Figure 5:
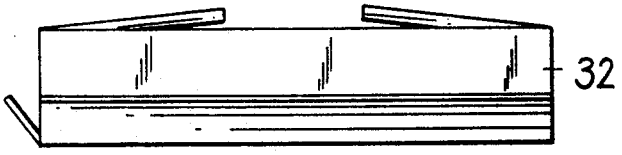
FIG. 5 is a side view of the container in collapsed condition with cover element removed.

The main body element 11 (See FIGS. 1 and 2) includes a lower main wall 20 interconnected to first and second foldable side walls 21 and 22, and end walls 23 and 24. Secured to the undersurface of the bottom wall 20 is a fiber slip sheet 25 of known type having first and second foldably interconnected flap members 26 and 27 to facilitate the engagement of a forklift therebeneath. Each of the side walls 21 and 22 is provided with a horizontal fold line 28 as well as first and second angular fold lines 29 and 30. The horizontal fold lines 28 continue through the end walls 23 and 24 to define a well are 32 (See FIG. 5) which remains erect after the remaining portions of the element 11 have been collapsed.

The cover element 12 is generally conventional, and includes a horizontal main wall 40 and a continuous side wall 41 including a pair of longer sides 42 and a pair of shorter sides 43.

Figure 4:
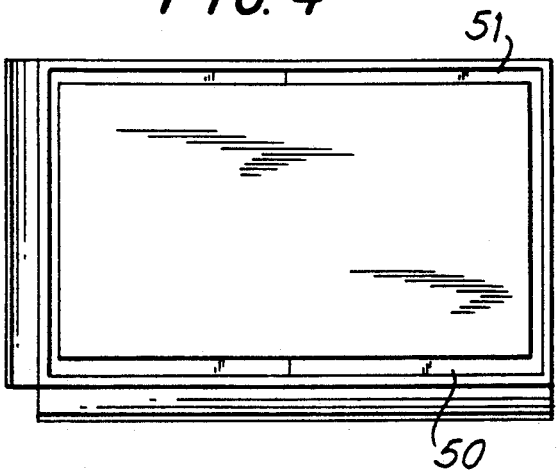
FIG. 4 is a similar top plan view with the liner element folded and positioned in horizontal position prior to collapsing the container.

The liner element 13 is also of known type, and is similar to that disclosed in my copending application Ser. No. 07/716,260 filed Jun. 17, 1991, now U.S. Pat. No. 5,090,614, entitled Collapsible Reinforced Shipping Container. It includes first and second longer sides 50 and 51 as well as first and second foldable shorter sides 52 and 53 which permit the same to be placed in flattened condition as shown in FIG. 4. Side 50 is provided with first and second through openings 55 and 56, one of which is rectangular in configuration, and the other of which is hexagonal in configuration to permit the use of a gland (not shown) of known type to provide for drainage of the bag element 15, as will more fully appear hereinafter. These openings are selectively alignable with a single opening 57 in side wall 21 by merely inverting the liner element depending upon which shape is required.

Figure 3:
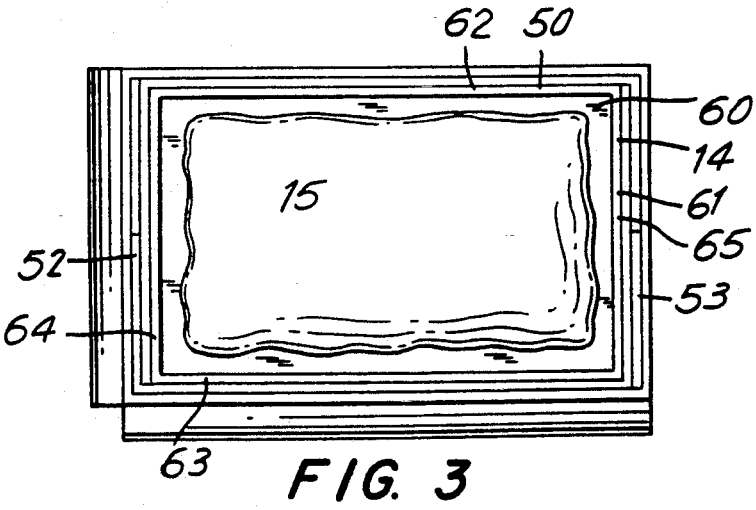
FIG. 3 is a similar top plan view with a flexible partially filled inner bag element and erected liner element in position.

The tray element 14 is adapted to overlie the bottom wall 20 of the main body element, and is somewhat smaller in configuration to permit the same to be surrounded by an erected liner element (See FIG. 3). It includes a bottom wall 60 bordered by a foldable rim 61 including first and second longer sides 62 and 63 and first and second shorter sides 64 and 65. In fixed position it defines a rectangular groove 66 into which a continuous edge of the erected liner element 13 is placed when the device is in erected condition.

The bag element 15 is also of known type, and is formed of synthetic resinous materials which are impervious to the hazardous concentrates which are shipped within the device. It includes a lower drain opening (not shown) communicating with a known gland which penetrates the opening 57 and either of the openings 55 and 56 to permit the bag to be drained through the body element. Although the bag element is normally adequate from the standpoint of seepage, where desired, the upper surface and inner surfaces of the tray element may be suitably coated to render them liquid proof.

The device is prepared for use by placing the main body element 11 in erected condition, and partially filling the bag element 15 with concentrate, either liquid or particulate to a degree which will permit the remaining parts to be collapsed and folded and stored within the confines of the tray element 14. Next, the liner element 13 in collapsed condition is positioned upon the tray element, which is in erected condition, so as to lie entirely within the well area 32. The main body element 11 is then collapsed, following which the cover element 12 is positioned thereon, and the container sealed using any convenient means. It is now ready for shipment.

Upon arrival at its destination, the cover element is removed and the main body element is erected. The liner element 13 is then erected, and positioned so as to surround the tray element to provide additional reinforcement against bulging. The bag element is then unfolded, inflated with filtered air or nitrogen to form a squared shape with all walls parallel to the liner element, and repositioned such that it is then connected to a gland (not shown), if not already connected at the time of shipment, which permits communication between the lower end of the bag through the liner element and side wall of the main body element, following which suitable valving means (not shown) is connected.

The upper end of the bag is then opened and the bag is filled with the desired amount of solvent, i.e., water, so that the concentrate is diluted to desired concentration for use. The upper end of the bag is subsequently closed, and if desired, the cover element 12 may be repositioned upon the now erected main body element. The contents of the bag are drained as required until the bag has been substantially emptied. At this point, the valving means is disconnected, and the now empty bag is collapsed and folded to again be stored within the well area 32 upon the tray element 14. In the alternative, the bag element, if not to be reused, may be discarded in accordance with environmental regulations. The tray element itself may then be collapsed, and the liner element 13 collapsed and placed upon the same in horizontal condition. Following this, the main body element 11 is collapsed, the cover element 12 repositioned and sealed, the device being thus readied for shipment to its source of origin.

It is to be noted that when the container is originally packed, the side walls of the tray element support the folded liner element, so that should the liner element shift during shipment, it does not contact the collapsed bag to result in possible damage thereto.

Figure 8:
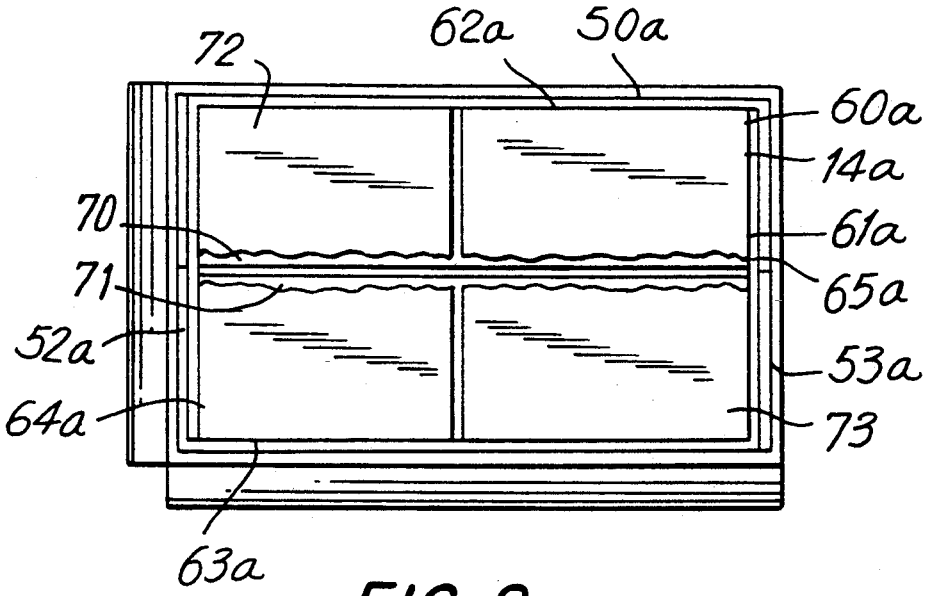
FIG. 8 is a top plan view corresponding to that seen in FIG. 3, but showing an alternate form of construction.
Figure 9:
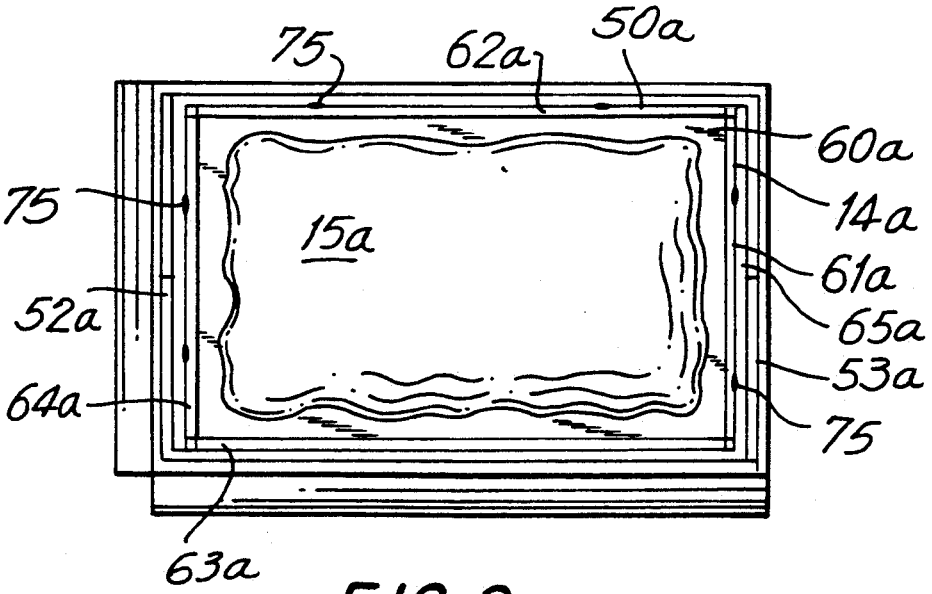
FIG. 9 is a top plan view corresponding to that shown in FIG. 8, with certain of the component parts in altered relative condition.

Turning now to the alternative form of construction shown in FIGS. 8 and 9, parts corresponding to those of the principal form have been designated by corresponding reference numerals with the additional suffix "a".

In the alternate form, the tray element **14*a* is provided with conventional folding flaps 70, 71, 72 and 73 which enable the tray element to be completely closed after the insertion o the bag element. In this condition, the flaps add additional rigidity to the tray element, and provide a smooth upper surface so that when the liner element is moved from folded condition to erected condition, the lower edge of the same may be rested upon this surface while it is being erected and engaged. Immediately thereafter, the flaps 70–73 are pivoted to vertical condition, and may be secured against the inner surface of the liner element 13*a* by interconnected hook and pile means indicated by reference character 75 in FIG. 9**. The presence of these flaps adds additional rigidity to the main body element when so engaged, and provides the rigidity to the tray element when in folded condition.

I wish it to be understood that I do not consider the invention to be limited to the precise details shown and set forth in this specification, for obvious modifications will occur to those skilled in the art to which the invention pertains.

I claim:

1. A method for the shipping of hazardous concentrates in liquid and particulate forms comprising the steps of:

a) providing a collapsible shipping container defining a non-collapsible generally rectangularly shaped well at a lower end thereof, said container having a collapsible impervious bag of dimensions corresponding to the interior of said container when in erected condition;

b) Partially filling and sealing said bag with a concentrate to a degree permitting said bag in subsequently folded condition to be store within said well;

c) Positioning said partially filled bag within said well;

d) collapsing said container to enclose said well;

e) shipping said container to a user in collapsed condition;

f) upon arrival to said user, erecting said container and bag and filling the remaining volume of said bag with a diluent or solvent to dilute or dissolve said concentrate to a desired degree of concentration;

g) employing said container and bag as a storage facility while draining required amounts of material therefrom; and h) upon the substantial emptying of said bag, collapsing said bag for reuse or discard, returning the same to storage in said well, and recollapsing said container for return shipment.

2. The method in accordance with claim 1 including the step of providing a hollow tray element and positioning the same within said well prior to placing said partially filled bag upon said tray for initial shipment.

3. The method in accordance with claim 1, including the step of providing a collapsible hollow tray element for holding said partially filled bag, and placing said tray element in erected condition in said well prior to positioning said partially filled bag therein for shipment.

4. An improved shipping container for the transportation of hazardous concentrates comprising: a generally rectangular outer element having a non-collapsible well at a lower end thereof, a bag receiving tray element of configuration corresponding to the interior of said well, said tray element having a bottom wall and a continuous side wall; and a collapsible generally impervious bag element capable of holding particulate and liquid concentrates, said bag element being only partially filled with such concentrate to a degree permitting the storage of the same within said well.

5. An improved shipping container in accordance with claim 4, in which the tray element is collapsible to generally planar condition.

6. An improved shipping container in accordance with claim 4, in which said tray element serves to reinforce said well.

7. An improved shipping container in accordance with claim 4, in which said tray element defines an inner surface which is chemically inert relative to said concentrate.

8. An improved shipping container in accordance with claim 4 further comprising a collapsible liner element selectively positionable within said well in collapsed condition, and within the expanded walls of said outer element to surround said tray element.

9. An improved shipping container in accordance with claim 4, further comprising said tray element having foldable flaps at an upper edge of said continuous side wall which enclose the interior of said wall in folded condition, and reinforce said outer element when placed in coplanar relation to said side wall of said tray element.

* * * * *